US007687696B2

(12) United States Patent
Fox

(10) Patent No.: US 7,687,696 B2
(45) **Date of Patent: *Mar. 30, 2010**

(54) TONALLY IMPROVED HOLLOW BODY STRINGED INSTRUMENT

(76) Inventor: Charles Edward Fox, 2745 SW. Scenic Dr., Portland, OR (US) 97225

( * ) Notice: Subject to any disclaimer, the term of this patent is extended or adjusted under 35 U.S.C. 154(b) by 0 days.

This patent is subject to a terminal disclaimer.

(21) Appl. No.: 12/008,333

(22) Filed: Jan. 9, 2008

(65) Prior Publication Data

US 2008/0110318 A1 May 15, 2008

Related U.S. Application Data

(63) Continuation-in-part of application No. 11/198,791, filed on Aug. 5, 2005, now Pat. No. 7,342,161.

(51) Int. Cl.
*G10D 3/00* (2006.01)

(52) U.S. Cl. ..... 84/290; 84/267

(58) Field of Classification Search ..... 84/290, 84/291, 267, 193, 173; D17/14
See application file for complete search history.

(56) References Cited

U.S. PATENT DOCUMENTS 2,154,025 A * 4/1939 Born ..... 84/277
6,107,552 A * 8/2000 Coomar et al. ..... 84/291
6,639,135 B1 * 10/2003 Lucas ..... 84/291
6,683,236 B2 * 1/2004 Davis et al. ..... 84/291
6,942,757 B1 * 9/2005 Iwama et al. ..... 162/157.3
7,002,070 B2 * 2/2006 Katz ..... 84/718
7,145,064 B2 * 12/2006 Geiger ..... 84/294
2002/0005105 A1 * 1/2002 McPherson ..... 84/291
2005/0252363 A1 * 11/2005 Rockett ..... 84/723
2006/0042447 A1 * 3/2006 Schleske ..... 84/275

* cited by examiner

*Primary Examiner*—Jianchun Qin
(74) *Attorney, Agent, or Firm*—Mark S. Hubert

(57) ABSTRACT

The present invention is a hollow body stringed musical instrument that utilizes a low mass, soundboard having a 12 to 25 foot radius dome configuration. The soundboard is made of a three ply torsion box design utilizing a honeycomb stiffening layer as the central core. Linear adjustable tuning braces are incorporated in the hollow body. The side and back of the instrument are also of a three ply construction having a polymer ir inorganic foam as the central layer. (Preferably this will be a closed cell foam.) The back also has a domed configuration with a 12 to 15 foot radius. All structural braces are eliminated from the interior of the instrument's body.

4 Claims, 7 Drawing Sheets

(SECTION A-A)

TONALLY IMPROVED HOLLOW BODY STRINGED INSTRUMENT

CROSS REFERENCE TO RELATED APPLICATIONS

U.S. non-provisional application Ser. No. 11/198,791 filed Aug. 5, 2005, issued to patent on Mar. 11, 2008, U.S. Pat. No. 7,342,161 B1.

This application is a continuation-in-part of application claiming benefit under 35 U.S.C. §121 U.S. non-provisional application Ser. No. 11/198,791 filed Oct. 16, 2006. The benefit of which is claimed, is considered to be a part of the disclosure of the accompanying application and is hereby incorporated herein its entirety by reference.

BACKGROUND OF THE INVENTION

The acoustic hollow-body guitar, herein referred to as the 'guitar', in its various forms is among the most popular of musical instruments in use today and is central to a multitude of traditional and contemporary musical genres. As such, the guitar has evolved, and continues to evolve, both in response to changing musical styles and needs, and in response to a maturing appreciation of its subtler tonal and expressive qualities and the possibilities for further development in this regard.

The particular sound or 'voice' of an individual guitar derives from its overall design, materials and construction. The sound that we hear is the result of the plucked strings' patterned energy being filtered through the guitar's unique combination of physical attributes, resulting in complex behaviors of its planar surfaces and enclosed air volume, which produce patterned compression waves in the instrument's immediate atmosphere. These waves, traveling through the air to excite our eardrums as impulses which register as sound in our brain, represent more or less of the strings' original energetic activity. The amount and harmonic depth of the original string signal that is manifest in audible form is a basic measure of a guitar's acoustic quality.

The driven and sympathetic activity of the guitar's compliant top and back plates, and of its enclosed air chamber, serve to 'amplify' the otherwise inaudible energy of the vibrating strings and to enhance that signal with their natural resonances. To the degree that the resonances of these three active components are both strong and tuned to intended frequencies, the potential exists for an instrument of exceptional power and tonal quality. Unfortunately, some basic elements of conventional guitar design make the manipulation and control of the guitar's main resonances extremely difficult if not literally impossible. An approach to guitar construction that allows for and facilitates adjusting the amplitudes and center frequencies of the instrument's main resonances represents an advance of the guitar makers' art.

The various concurrent 'dimensions' of the guitar—its acoustical, structural, functional, and aesthetic realms—are inseparably linked as a coupled system throughout, making the manipulation of any single variable in isolation from the rest of it, all but impossible. The intimately bound and often antagonistic relationship between the guitar's acoustical and structural functions is well known to experienced guitar makers. Actions at the workbench which are intended to optimize either one of these primary and equally important aspects of the guitar can simultaneously compromise the other aspects in ways often unanticipated by builders with limited experience in, and knowledge of the craft. Understanding and balancing the often contradictory requirements of acoustical brilliance on the one hand and structural soundness on the other is one of the guitar maker's most fundamental and constant challenges, the resolution of which is often ultimately frustrated by limitations that are inherent in standard guitar construction practices. The need to overcome or to at least extend those limitations requires a reexamination of standard construction conventions and inspires the present alternative, less limiting approach to some of the craft's more problematic design issues.

The present invention relates to a steel string acoustic guitar that achieves both its desirable tonal qualities and its exceptional structural integrity through the incorporation of unique construction design elements in the guitar's body—particularly from the use of domed, composite, low-mass honeycomb-core top (soundboard) and back plates, each with adjustable (variable stiffness) tone bars, along with a composite, relatively thick-walled, rigid rim which functions as an independent superstructure to which the guitar's aforementioned top and back plates, and its neck, are separately attached.

Because a plucked string's energy is finite—limited and short-lived—the efficiency and completeness with which that energy is converted into sound is a basic measure of a guitar's usefulness and value as a musical instrument. One approach to harvesting as much as possible of the strings' energy for sound is to minimize the amount of that energy that is required to move the weight of the soundboard. Lower mass—less soundboard weight—generally correlates to greater soundboard efficiency. Beyond preserving precious string energy, a lighter, more sensitive soundboard can potentially respond to and make audible more of the strings' finer/higher harmonic content, further enriching the character of the instrument's musical voice.

With less mass needing to be set into motion before each note can be realized, a lighter soundboard can also deliver a quicker, more immediate response to the player's fingers' attack. By contrast, many otherwise fine sounding guitars have a "speed limit", notes played faster than which lose their crisp separation and seem to overlap in an aural "jumble". A guitar with the shortest, most immediate response time—a guitar that cannot be over run by the fastest finger work—is an especially desirable quality in today's world of virtuoso guitar players.

Typical sets of six steel strings pull on the soundboard with approximately 140 to 200 pounds of tension. Because the conventional solid wood soundboard plate, made thin and light enough to be driven efficiently by the strings, is, by itself, too easily distorted and pulled up above its proper height by the pull of the strings, prior art installs stiff wooden longitudinal braces on the underside of the soundboard plate to maintain the plate's intended contour and orientation. While accomplishing their stabilizing purpose, these structural members impose on the soundboard more or less arbitrary patterns of stiffness that lie across antinodes of the plate's various natural resonance modes, inhibiting and/or essentially eliminating them from the plate's potentially complete set of stacked natural resonances. This creates "holes" or gaps in the guitar's frequency output response, an unintended filtering about which little can be done in the context of conventional construction.

The composite, domed, low-mass 'torsion box' structure of the soundboard plate of the present invention, while lighter in weight than its conventional solid wood equivalent, is strong enough to resist distorting in response to the pull of the strings, without the use of conventional braces in the critical lower bout—the region of the soundboard's main diaphragm. Thus, unrestricted to a significant degree in its responses to the strings' energy input, and more uniform in its directional stiffness, the soundboard of the present invention is free to realize the entire range of its natural resonances more fully than in a conventional soundboard. The resulting more complete frequency output can be heard clearly as what has anecdotally been called "more piano-like" in describing its fullness of tonal content, and it can be clearly seen, when charted by spectral analysis instrumentation, as maintaining an unusually consistent output level across its frequency range, without the typically deep, irregular gaps that characterize the charted output levels of conventionally constructed guitars.

While the above discussion is focused on the nature and activity of the directly driven soundboard, much the same can be said of the guitar's back plate, which is driven less directly by the activity of the soundboard, and principally through the enclosed air volume's patterned changes in pressure. The back plate of the present invention enjoys the same freedom from the conventional braces and the effects of their overlaid patterns of stiffness. The basic stiffness of the present back plate can be varied in it's laminated construction, casting it as a more rigid energy reflector or conversely as a more compliant secondary resonator and radiator.

In a similar but different lamination scheme, the guitar rim (the "sides") of the present invention has been made thicker and stronger, thereby eliminating both the need for side structural braces and the gluing surface offered by its broad cross-section. This in turn, eliminates the need for the perimeter linings that are required to join top and back plates to the conventionally thin, narrow edged rim. The natural resonance frequencies of the resulting thicker and relatively rigid rim are raised well above the compass of the instrument, essentially eliminating the potentially negative effects of the conventional thin-walled rim as an uncontrolled energy sink.

Freed from the arbitrary and potentially counter-productive restrictions imposed by conventional structural braces, certain aspects of the behavior of the soundboard and back plates of the present invention, such as their fundamental resonance frequencies and their overall relative stiffness, can now be brought under some control through the use of light weight-adjustable (variable stiffness) tone bars, strategically placed with regard to each plate's natural resonance modes. Beyond their role in establishing the desired resonant 'mix' in the new guitar's original setup, these adjustable tone bars can be used through the life of the instrument to maintain critical resonance relationships that might otherwise drift out of synch through the effects of either age or seasonal shifts in temperature and humidity. In addition to using the adjustable tone bars to optimize tonal quality in response to changing circumstances, these new devices can also be used to vary the instrument's 'voice' to suit the taste of its player.

This new invention utilizes and combines both known and new technologies in a unique and novel configuration to overcome the aforementioned problems of the prior art.

SUMMARY OF THE INVENTION

The general purpose of the present invention, which will be described subsequently in greater detail, is to provide a hollow body guitar that is able to produce a loud, "true" sound (one with superior tonal quality) having a shortened response or "lag' time between manipulation of the strings and the production of sound.

It has many of the advantages mentioned heretofore and many novel features that result in a new improved guitar which is not anticipated, rendered obvious, suggested, or even implied by any of the prior art, either alone or in any combination thereof.

In accordance with the invention, an object of the present invention is to provide an improved soundboard for a hollow body guitar capable of retaining its configuration without the use of braces.

It is another object of this invention to provide an improved soundboard for a stringed instrument that is tunable through the use of adjustable braces.

It is a further object of this invention to provide a hollow body guitar top having reduced mass that allows for the rapid transmission of sound capable of meeting or exceeding current industry standards.

It is still a further object of this invention to provide for a steel string hollow body guitar soundboard that has enhanced strength with a minimal mass.

It is yet a further object of this invention to provide for a steel string hollow body guitar back and side that has enhanced strength with reduced mass and no structural braces.

The subject matter of the present invention is particularly pointed out and distinctly claimed in the concluding portion of this specification. However, both the organization and method of operation, together with further advantages and objects thereof, may best be understood by reference to the following description taken in connection with accompanying drawings wherein like reference characters refer to like elements. Other objects, features and aspects of the present invention are discussed in greater detail below.

DETAILED DESCRIPTION

Figure 2:
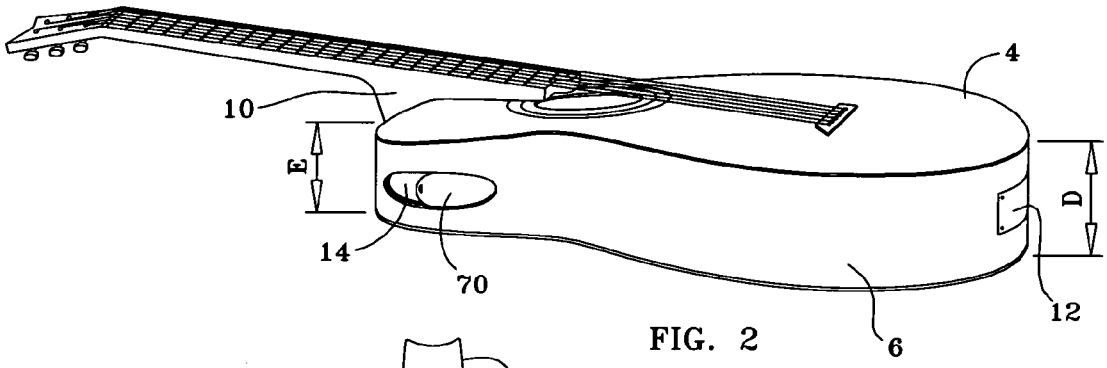
FIG. 2 is a top view of the preferred embodiment guitar.

The present invention provides a novel configuration that imparts improved tonal quality, volume, and response time for an acoustic hollow-body steel six-string guitar. There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. More particularly, elements of this invention may be utilized by other hollow body stringed instruments such as mandolins, sitars, violins, violas, cellos, ukeleles, etc. Further, although discussed with regard to a steel six-string hollow body acoustic guitar, the novel and inventive elements discussed herein may be utilized with similar steel twelve-string guitars and nylon string guitars. Also, it is to be understood that the phraseology and terminology employed herein are for the purpose of descriptions and should not be regarded as limiting.

For a thorough understanding of the importance and novelty of this invention, one must first understand how an acoustic guitar works. An acoustic guitar creates sound in the following way: the plucked guitar string vibrates, transmitting its vibrations to the saddle/bridge combination; the saddle transmits its vibrations to the soundboard; the soundboard vibrates both projecting the amplified sound off of it's generally planar surface, and pumping air (and thus sound) from inside the hollow body, out through the sound hole. (Only about 10% of the sound comes from the sound hole.)

The volume and response time of the guitar is a function of the speed and magnitude of vibration that the soundboard can develop. Thus, the entire key to achieving volume and a quick response time from the soundboard is to reduce its mass (so the string energy is not wasted by moving a heavy soundboard), and to maximize its flexibility. Keeping in mind that the tension on the steel string guitar's soundboard can range from 140 to over 200 pounds of force, the top must be resilient enough to withstand this force without distorting. To date, the prior art has satisfied this requirement by installing stiffening braces on the soundboard's inner surface. The unexamined patterns of stiffness introduced by these structural braces cause unintended tonal distortion and add further mass to the soundboard. An unexplored approach to achieving superior tonal quality is to remove the localized regions of stiffness introduced by structural braces onto the guitar top.

The present invention renders a light, responsive soundboard. It has less mass due to its laminated, torsion box soundboard and due to the elimination of structural braces. The other elements incorporated into the various embodiments improve the tonal quality of the guitar and/or the ergonomics for the guitarist.

Figure 7:
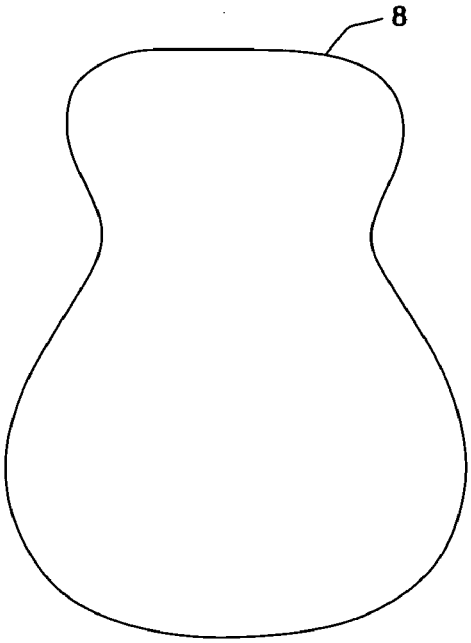
FIG. 7 is a view of the inner side of the preferred embodiment guitar back without structural braces.

The present invention relates to an improved, hollow body acoustic guitar. Looking at FIGS. 1 and 2 it can be seen that the guitar 2 has a domed top (soundboard) 4, a domed back 8 (See FIG. 7), a tapered side wall 6 substantially normal and connected to both the back 8 and the soundboard 4, an elevated neck 10, an access panel 12, an adjustable sound port 14, a sound hole 16, a bridge 18, a saddle 20, strings 24, frets 26, a head 36, nut 34 and tuning pegs 28. The body of most acoustic guitars has a "waist," or a narrowing 22 located about the centerline of the sound hole 16, to make it easy to rest the guitar on a knee. The two widenings are called bouts. The upper bout 30 is where the neck 10 connects, and the lower bout 32 is where the bridge attaches. The lower bout 32 accentuates lower tones and the upper bout 30 accentuates higher tones. Finally, between the neck 10 and the head 36 is a piece called the nut 34, which is grooved to accept the strings.

The invention is best described by addressing its individual elements and features separately.

The Soundboard

Figure 3:
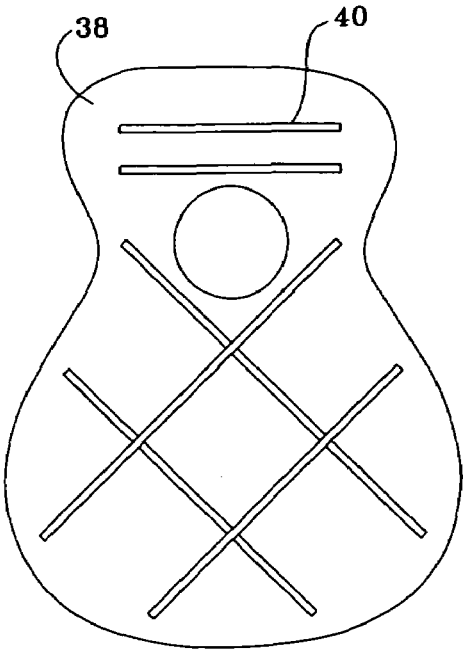
FIG. 3 is a view of the inner side of a guitar back showing one possible brace configuration.

FIG. 3 illustrates the inner surface of the soundboard of a conventional guitar 38. Structural braces 40 are generally placed across the upper bout region 30 to strengthen the area where the neck 10 connects to the guitar body. Similarly, structural braces are placed in a pattern strengthening the area of the lower bout 32 that lies directly below where the bridge 18 attaches to the soundboard 4. These braces 40 although introducing patterns of stiffness to the soundboard, are necessary to reinforce and strengthen the thin soundboard 4 so it will not pull apart or distort from the stresses introduced at the neck 10 and bridge 18. The present invention eliminates structural braces 40.

Figure 9:
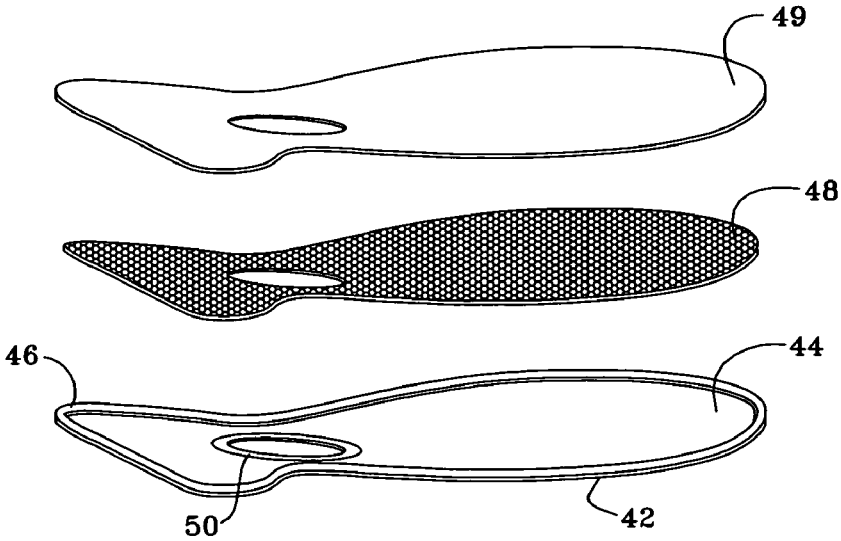
FIG. 9 is an exploded illustration of the preferred embodiment soundboard.

Looking at FIG. 9, although illustrated upside down, the general laminated three ply construction of this invention's soundboard 4 can best be seen. Top skin 42 is made from any of a variety of generally planar materials selected for their appearance, flexibility, strength and tonal characteristics. While traditionally guitar makers have relied upon woods such as spruce or cedar, the present invention additionally utilizes wood based products (such as vulcanized fibreboard and other cellulose derived composites) and polymers (such as epoxy graphite, HDPE and the like.) In the wooden embodiment illustrated, the thickness of top skin 42 is approximately 0.090 of an inch thick. The interior region of top skin 42 has been removed to a depth of approximately 0.060 of an inch to create laminate depression 44 except for a ⅝ inch wide continuous flange, thick about the perimeter of the skin 42 and a 1¼ inch wide substantially similar second raised flange 50 about the sound hole 16 periphery. (The dimensions stated are for a wooden embodiment and will vary substantially with the use of the differing planar materials of construction.)

The middle ply is a stiffening laminate layer selected for it's ability to strengthen the soundboard, minimizing the soundboard's mass and easily accept a contoured configuration. Here it is a sheet of continuous hexagonal cell shapes know in the industry as a honeycomb core 48 that has been configured to match the depth and contours of laminate depression 44. Honeycomb cores are available in a variety of materials (both inorganic and organic based) for such sandwich structures. Although other geometrical physical configurations may be substituted, in the preferred embodiment honeycomb Nomex® is used as the central layer to form a torsion box configuration. Although Nomex® honeycomb is used as the honeycomb of the core, there are a plethora of alternate products such as ABS, Polycarbonate, Polypropylene, or Polyethylene (as well as a plethora of inorganic products) that would suffice. Nomex® honeycomb is made from Nomex® paper—a form of paper based on Kevlar®, rather than cellulose fibers. The initial paper honeycomb is an inert aramid reinforced fibre (basically a fiberglass composite) that is dipped in a phenolic resin to produce a honeycomb core with high mechanical properties, low density and good long-term stability.

The honeycomb core 48 is used not solely because of it's light weight, high strength and stiffness, but because it can be processed into both flat and curved composite structures, and can be made to conform to compound curves (such as is found in the domed guitar soundboard 4) without excessive mechanical force or heating.

Honeycomb core 48 is epoxied into laminate depression 44 of top skin 42 and the assembly is weighted and placed into a dished mold having a 12 to 25 foot circular radius. (Reference the alternate embodiment illustrated in FIG. 5) Honeycomb cores can give stiff and very light laminates but due to their very small bonding area they are almost exclusively used with high-performance resin systems such as epoxies so that the necessary adhesion to the laminate skins can be achieved.

The third ply (inner skin) 49 is also made from any of a variety of generally planar materials selected for their appearance, flexibility, strength and tonal characteristics. While traditionally guitar makers have relied upon woods such as spruce or cedar, the present invention additionally utilizes wood based products (such as vulcanized fibreboard and other cellulose derived composites) and polymers (such as epoxy graphite, HDPE and the like.) The third ply (inner skin) 49 in the illustrated wood embodiment is a generally planar sheet of wood 0.060 of an inch thick. The exposed honeycomb core 48 is epoxied to the third ply 49 and the three ply assembly 4 is weighted and placed in the dished mold. It is to be noted that the grain of inner skin 49 is laid up perpendicular to the grain of top skin 42 to add dimensional stability and strength. (Where wood is not used as the material of construction, the orientation of the first and third plies may or may not be relevant as differing material may or may not have a directional bias or orientation of stiffness.) With the first and third plies being of wood, the addition of the honeycomb core increases the relative stiffness and strength of the soundboard while decreasing the overall mass relative to that of a traditional solid wood soundboard.

The soundboard 4 while appearing to be generally planar, has a slight curvature with a radius of between 12-25 feet with the preferred embodiment being 12 feet. This radius is a severe radius in the world of guitar soundboards whereas conventional soundboards have radii of 25 feet or greater. This pre-stressing further increases the strength of the soundboard 4. There is a careful balance between the reduction in mass and the increase in stiffness of the soundboard 4. The abovementioned configuration of a domed, three ply, torsion box soundboard 4 with removed structural braces 40 gives the guitar a tonally improved "voice", a lower mass (quicker response) and enhanced vibrational response (louder volume) as compared to a conventional guitar.

Figure 4:
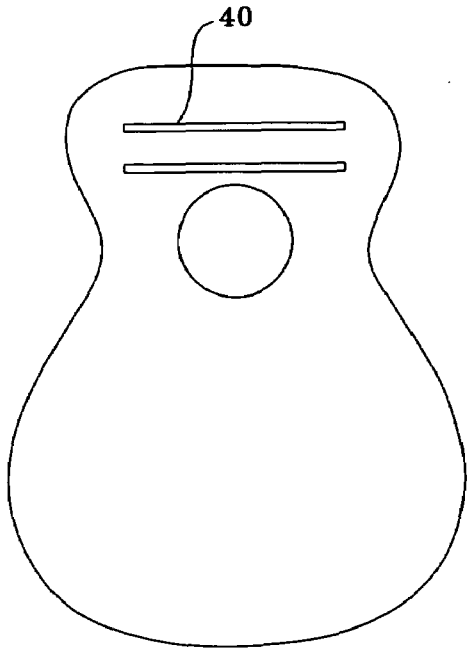
FIG. 4 is a view of the inner side of a guitar back showing a second possible brace configuration in the upper bout region.
Figure 6:
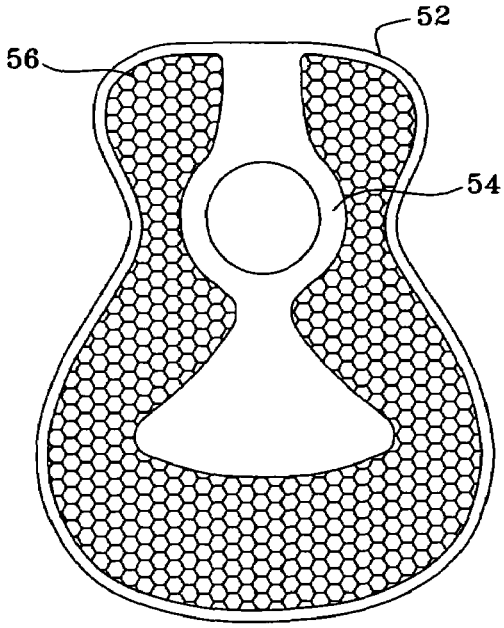
FIG. 6 is a view of the inner side of a soundboard outer skin with the honeycomb residing in it's patterned depressed region.

Looking at FIG. 6 the preferred embodiment of the soundboard 4 is illustrated. Preferred wooden top skin 52 has larger flange 54 that spans the regions directly below where the neck 10 attaches and where the bridge 18 attaches on the other side of the skin 52. The preferred honeycomb core 56 is correspondingly configured. This gives a larger glueing surface since the third ply 49 would be directly laminated to the top skin 52 in these regions. This gives extra strength to prevent delaminating of the Honeycomb core 48 from either or both of the other skins under the mechanical load imposed by the tension of the strings 24 onto the neck 10 and the bridge 18. In this embodiment the third ply 49 is unchanged. The soundboard is laid up in a 12 to 25 foot radius dome. In this embodiment structural braces are only used on the underside of the soundboard 4 in the region of the upper bout 30. (Reference FIG. 4) The soundboard 4 is top sanded removing material such that the overall thickness of the soundboard 4 is about 0.140 of an inch thick.

The Back

Figure 8:
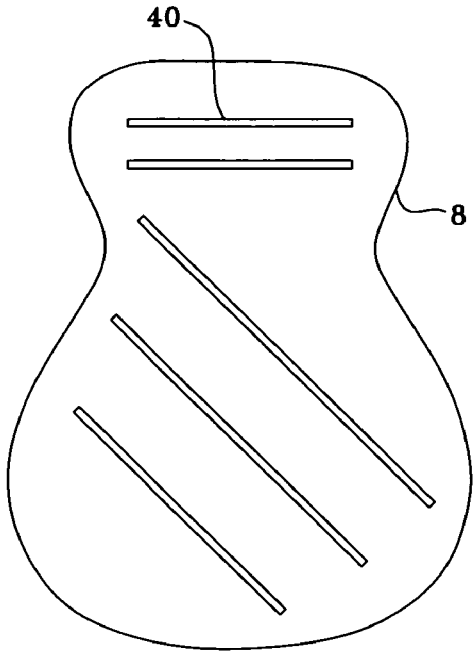
FIG. 8 is a view of the inner side of an alternate embodiment guitar back with structural braces.
Figure 13:
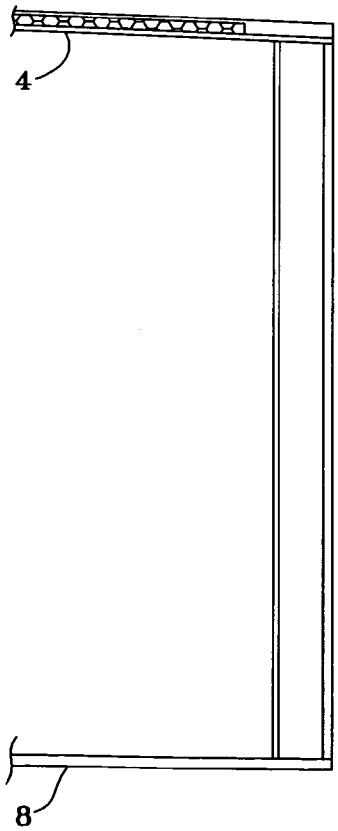
FIG. 13 is an enlarged view of the right side of FIG. 12.

Referring to FIGS. 8 and 13, a conventional guitar back 8 has been illustrated. Structural braces 40 are placed in a configuration as dictated by that particular Guitar maker. The back 8 is generally made of a wood, however (similar to the first and third plies) it may also be made from any of a variety of generally planar materials selected for their appearance, flexibility, strength and tonal characteristics. While traditionally guitar makers have relied upon woods such as mahogany or rosewood, the present invention additionally utilizes wood-based products (such as vulcanized fibreboard and other cellulose derived composites) and polymers (such as epoxy graphite, HDPE and the like.) In the illustrated wooden embodiment, the guitar back 8 is approximately 0.090 of an inch thick and also has a domed configuration having a 12 to 15 foot radius substantially smaller than that of the 12 to 25 foot radius of the preferred embodiment soundboard 52.

Figure 10:
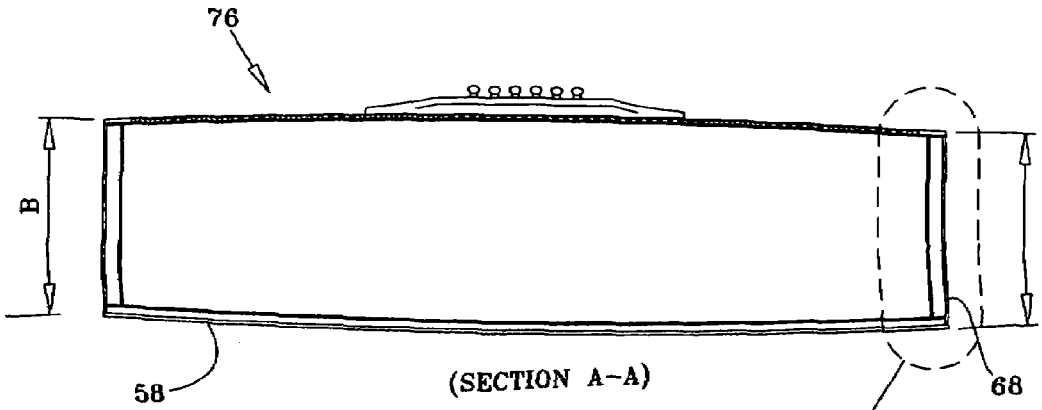
FIG. 10 is a cross sectional view of the alternate embodiment of the guitar taken through section A-A of FIG. 1.
Figure 11:
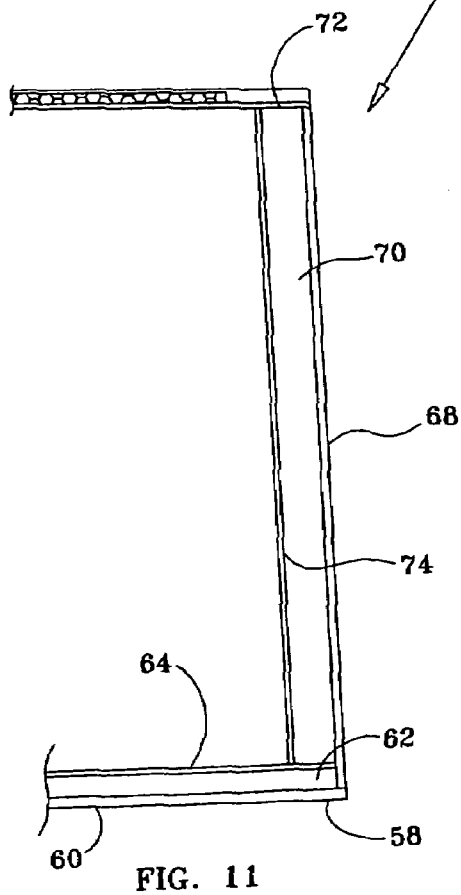
FIG. 11 is an enlarged view of the right side of FIG. 10.
Figure 12:
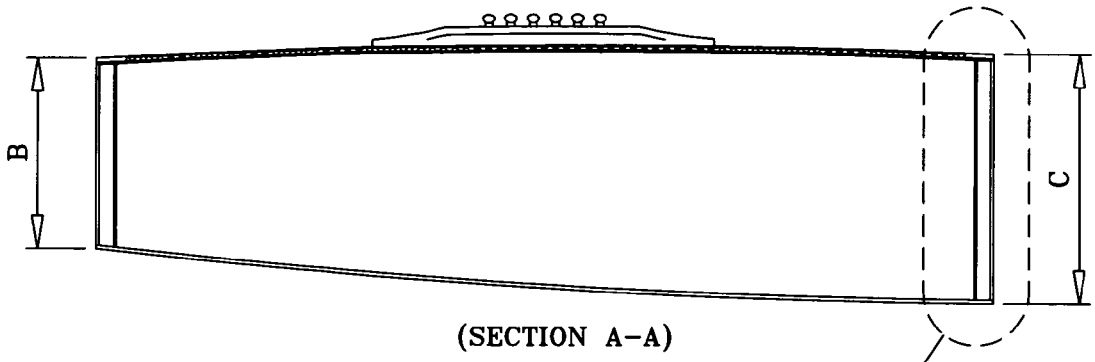
FIG. 12 is a cross sectional view of the preferred embodiment of the guitar taken through section A-A of FIG. 1.

FIGS. 10 and 11 show the alternate embodiment back 58. It is of a three ply construction, where in the outer skin 60 is 0.050 of an inch thick wood, the middle ply 62 is a 0.125 of an inch thick, heat formable lightweight cellular engineering materials (such as a polymer foam or organic foam), and the inner skin 64 is a 0.031 of an inch thick three ply plywood. (The foam may be an organic foam such as cellulose acetate.) A suitable adhesive is used to bond the plies together. This type of construction in the alternate embodiment back 58 offers increased strength and rigidity with reduced weight and simplifies the formation of the domed configuration. While traditionally made from wood, the outer skin 60 and the inner skin 64 may be replaced by thinner polymer or composite materials such as composite graphite. With such substitution the outer skin 60 and inner skin 64, will be substantially thinner. In another embodiment, not illustrated herein, the back 8 may be constructed in a three ply configuration substantially similar to that of the soundboard 4 with the exception of the flange configuration utilized in the soundboard to accommodate the requirement for enhanced strength in the region of the soundhole and the bridge.

The Side (Rim)

Figure 1:
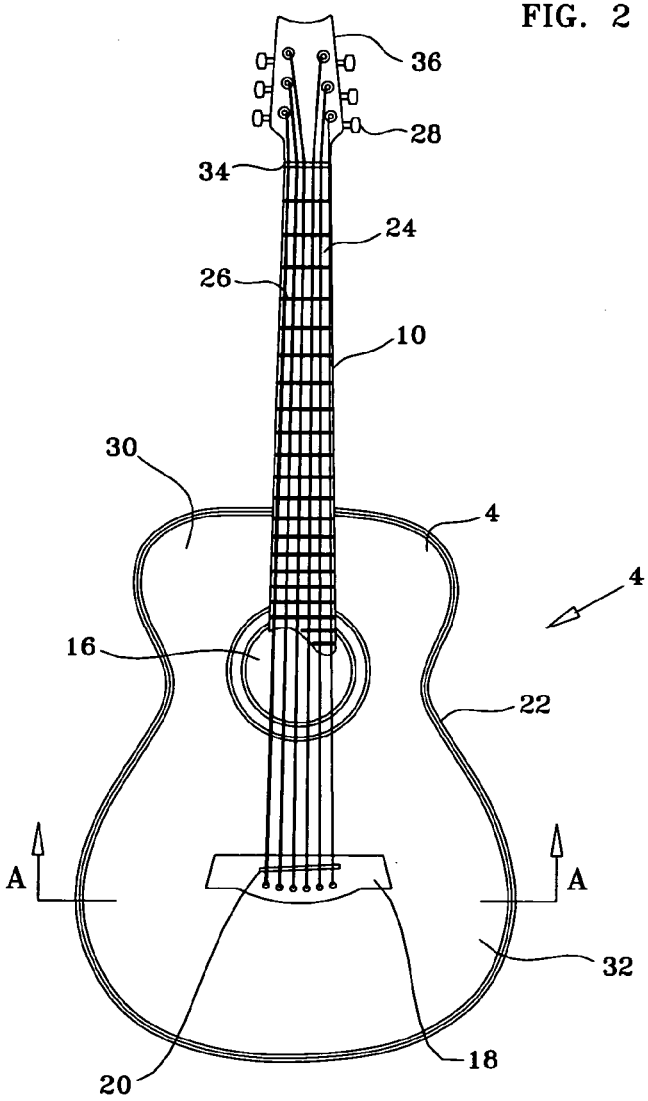
FIG. 1 is an angled side perspective view of the preferred embodiment guitar.

Referring to FIGS. 1, 6 and 17 the preferred embodiment of guitar side 6 can best be seen. The side 6 is generally made from wood having a thickness of approximately 0.090 of an inch. Similar to the soundboard and back, polymer or composite materials of reduced thickness may be substituted for the wood. The side 6 is attached to the soundboard 4 and the back 8 by adhesive fixation to corner brace (lining) 66. (This is a traditional or conventional construction technique that is eliminated in the alternate embodiment with the thicker cross section of the side.) When An adjustable sound port 14 is located above the waste 22 in the upper bout 30 region. It is of a generally electrical configuration and has a slidable door 70. Fabrication and assembly of such would be well known by one skilled in the art. The adjustable port 14 allows some of the sound generated within the hollow body to be directed to the guitarist's ear. A curved removable access panel 12 is located in the lower bout 32 region in line with the horizontal axis of the neck 10. The internal region of the hollow body guitar may be accessed by removal of mechanical fasteners used to secure the access panel 12. The detailed configuration of the adjustable sound port 14 slidable door 70 and access panel 12 would be well-known to one skilled in the art.

FIGS. 10 and 11 illustrate an alternate embodiment side 68. The alternate embodiment uses a three ply construction substantially similar to that of alternate embodiment back 58, except that the heat formable foam (lightweight cellular engineering material) side middle ply 78 is 0.250 of an inch thick.

This allows for a larger adhesive surface 72, between the alternate embodiment side 68 and whichever configuration of guitar soundboard and back are utilized. This enhanced adhesive surface eliminates the need for side braces (lining) 66, therein simplifying construction. The side and inner plies 74 are approximately 0.030 of an inch thick when constructed of three ply plywood, however this thickness will vary depending which planar material of construction is used. IE solid wood side and inner plies 74 will be thicker than would those built of wood based products (such as vulcanized fibreboard and other cellulose derived composites) or polymers (such as epoxy graphite, HDPE and the like.)

Since the middle ply 78, is heat formable this type of construction simplifies the formation of the side contours about the waste 22 lower bout 32 and upper bout 30.

The Neck

Referring now to FIG. 2 it can be seen that neck 10 has an elevated profile above soundboard 4 in the upper bout 30 region. This raised profile increases, the acute angle between guitar strings 24 and bridge 18. This slightly changes the angle of tension from which the guitar strings 24 pull on the domed soundboard 4, helping to pull it up into its intended shape instead of trying to distort it as when pulling on the soundboard from the conventional lower angle.

In the preferred embodiment, the playing surface of the neck 10 rotates/twists slightly away from the player, along its longitudinal axis, to optimize the player's left hand comfort.

The Guitar Body

Referring to FIGS. 2 and 10, the overall shape of the guitar body can be seen. The guitar body 76 is made of the assembled soundboard 4, side 6 and back 8. The guitar body's longitudinal axis is aligned with the longitudinal axis of the neck 10. The depth of the lower bout 32, indicated by dimensional line D is greater than the depth of the upper bout 30 indicated by dimensional line E. This gives guitar body 76, a gradual downward first taper approaching the neck 10. Looking at the cross-sectional section of guitar body 76 taken perpendicular to its longitudinal axis, it can be seen that the depth of one side indicated by dimensional line C is approximately the same as the depth of the other side indicated by dimensional line B.

Adjustable Tone Bars

Figure 14:
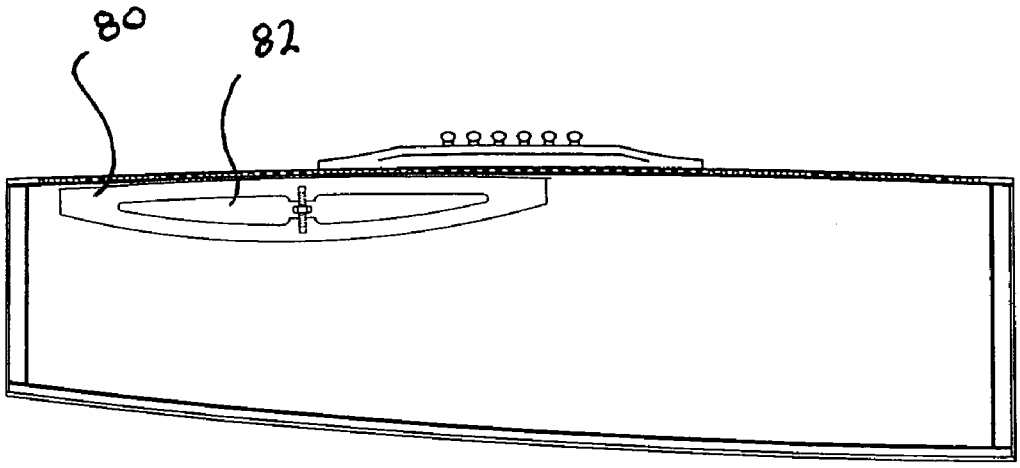
FIG. 14 is a side view of a tunable brace installed in a cut away guitar.
Figure 15:
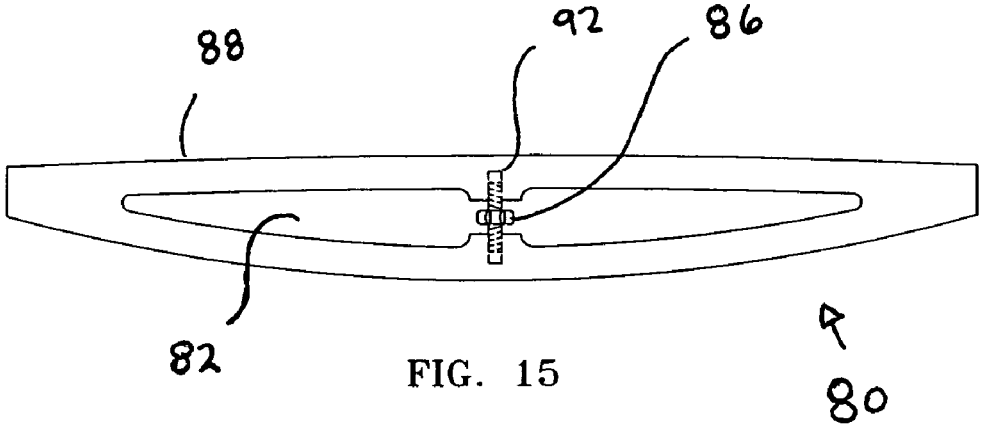
FIG. 15 is side view of a tunable brace.

An adjustable (variable stiffness) tone bar is a thin, lightweight, linear member that can be affixed anywhere to the inner side of a soundboard or guitar back and can be either stiffened or relaxed to control the resonant behavior of those plates, in pursuit of the optimal tone quality that a guitar is capable of creating. Referring to FIGS. 14 and 15 it can be seen that an adjustable tone bar 80 is a generally elliptical shaped member with a configured, cutout center 82. Only one of the sides is affixed to the guitar. The outer curvature of the guitar side 88 corresponds to the radius of the domed soundboard or back. The opposing floating side 90 of this member and the guitar side 88 are each threadingly engaged at threaded recesses 92 with a central adjustable thumbscrew 86 that can be adjusted to place these opposing sides in various levels of tension or compression with respect to each other to stiffen or relax the adjustable tone bar 80. The adjustable tone bar 80 may be incorporated into any of the various embodiments. It is constructed from wood or a lightweight polymer. The size of the adjustable tone bar may be varied as well as the number and placement of the adjustable tone bars. Each guitar must be tuned as per the guitar maker's specific desires.

The above description is just one example among many of how the principle of mechanically adjustable tone bars/stiffeners might be implemented.

The Preferred Embodiment

Figure 16:
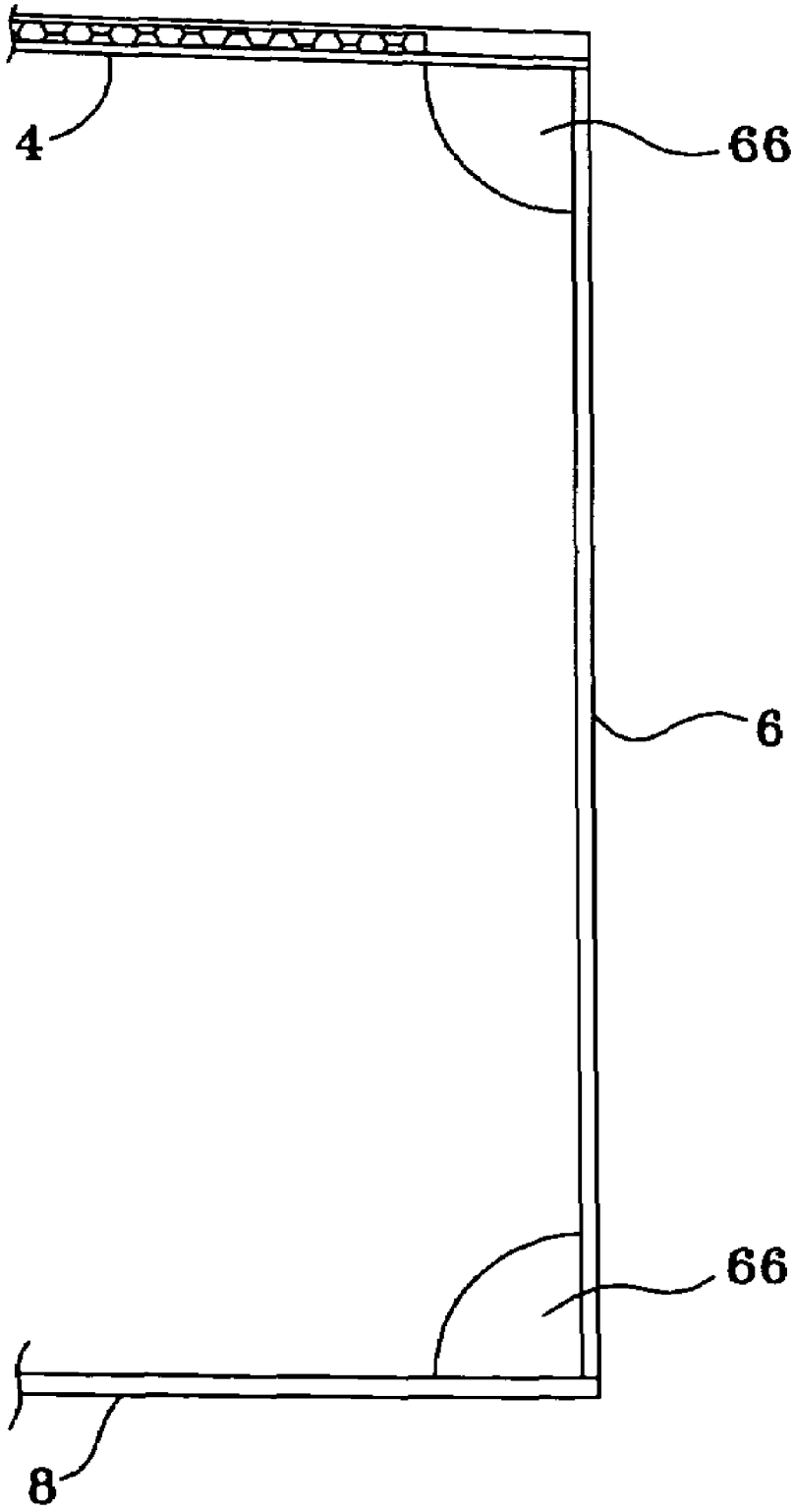
FIG. 16 is a cross sectional view of the preferred embodiment of the guitar taken through section A-A of FIG. 1.

The preferred embodiment of the total improved hollow body stringed instrument is a steel string, hollow body, acoustic guitar 2 as shown in FIG. 2. It's soundboard 4 is of a three ply, torsion box 12 to 25 foot radius domed configuration as seen in FIG. 6. There are no structural braces 40 in the lower bout 32 region of the soundboard 4. There are structural braces 40 on the soundboard in the upper bout 30 region beneath, where the neck 10 attaches to the guitar body. The side 6 and back 8 are as illustrated in FIG. 16. The back 8 is domed in the 12 to 15 foot radius and has structural braces 40 mounted thereon, as shown in FIG. 8. The actual location of the tone bars 40 upon back 8 will vary with the guitar maker. The preferred embodiment will have an adjustable sound port 14, removable access panel 12 and a raised profile design neck 10.

The Alternate Embodiment

Figure 5:
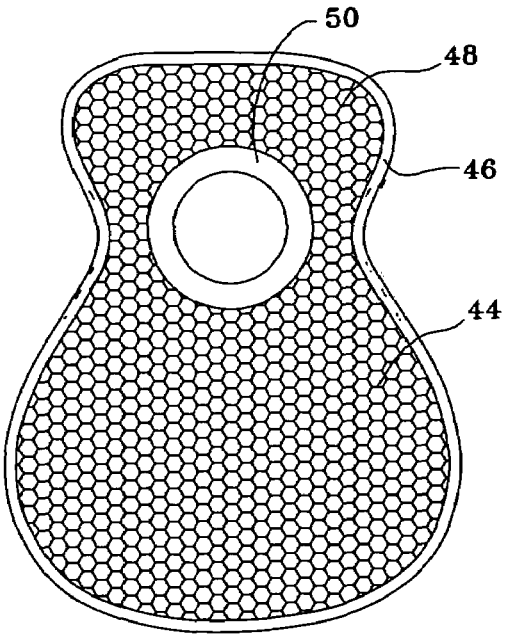
FIG. 5 is a view of the inner side of a soundboard outer skin with the honeycomb residing in it's depressed region.

The alternate embodiment of the total improved hollow body stringed instrument is a steel string, hollow body, acoustic guitar having a soundboard 46 of a three ply, torsion box 12 to 25 foot radius domed configuration as seen in FIG. 5 with two separate flanges. The soundboard will have no structural braces 40 thereon. The alternate embodiment side 68 will be of a three ply construction utilizing the 0.250 of an inch closed cell foam as illustrated in FIG. 11. The alternate embodiment back 58 will be of a domed 12 to 15 foot radius three ply construction utilizing 0.125 of an inch closed cell foam. The inside of back 58 will have no structural braces 40. There will be no structural braces 40, attaching back 58 to side 68 to soundboard 4. The remainder of the guitar, including the adjustable sound port 14, removable access panel 12 and raised profile neck 10 will remain substantially similar to that of the preferred embodiment.

The materials of construction for the first and third plies of the soundboard, the side and inner plies of the rim and the outer skin and inner skin of the back may be of wood, a wood based product, (such as vulcanized fibreboard and other cellulose derived composites) or a polymer (such as epoxy graphite, HDPE and the like) or any combination thereof. The foam and the stiffening laminate layer may be of an inorganic or organic based material.

It will be noted that all of the dimensions noted herein are with reference to a specific guitar and as such may deviate extensively in the dimensional tolerances. This is especially true in light of the thickness of the materials utilized.

The above description will enable any person skilled in the art to make and use this invention. It also sets forth the best modes for carrying out this invention. There are numerous variations and modifications thereof that will also remain readily apparent to others skilled in the art, now that the general principles of the present invention have been disclosed.

The above description will enable any person skilled in the art to make and use this invention. It also sets forth the best modes for carrying out this invention. There are numerous variations and modifications thereof that will also remain readily apparent to others skilled in the art, now that the general principles of the present invention have been disclosed. For example, the cells of the honeycomb core can also be filled with rigid foam to provide a greater bond area for the skins, and increase the mechanical properties of the core by stabilizing the cell walls and increasing thermal and acoustic insulation properties. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

The invention claimed is:

1. A hollow body stringed musical instrument comprising: strings;

a hollow body having a two and three layer constructed soundboard having a generally uniform thickness planar configuration with a sound orifice defined therethrough, affixed generally perpendicular to a side, which is affixed generally perpendicular to a back where said side maintains said back and said soundboard in a spaced relationship;

a neck with a fretboard, a head, a nut, and string tuning pegs thereon; and a bridge assembly of a bridge, saddle and string retention pegs; wherein said neck is affixed to said body so as to form a common longitudinal axis, and said bridge assembly is affixed to said soundboard such that strings connected between said bridge assembly and said tuning pegs reside substantially parallel to said longitudinal axis and above said sound orifice, wherein said soundboard is constructed in an adhesively affixed, two and three layer configuration of the first, second and third layers or first and third layers, having a first layer having an outer surface and an inner surface and said inner surface has a contoured depression thereon such that corresponds to a thickness and a contoured configuration of said second layer, a second stiffening layer and a third layer, and further, wherein said soundboard is contoured about a 12 to 15 foot radius, and wherein said back has a three ply form core construction made of an outer skin adhesively bonded to a foam middle ply which is adhesively bonded to an inner skin, and wherein said adjustable tone bar has a first longitudinal side, a second longitudinal side, a central orifice defined therein and an adjustable tensioning mechanism adapted to draw said first side and said second side into closer proximity to each other together, therein stiffening said sides, wherein said first longitudinal side is affixed to an inner surface of said soundboard or said back, and wherein said adjustable tensioning device is a rotatable member about a linear axis, having a first threaded end and a second threaded end, wherein said first threaded end is in threaded engagement with a first matingly threaded recess in said first side, and wherein said second threaded end is in threaded engagement with a second matingly threaded recess in said second side of said adjustable tone bar.

2. The hollow body stringed musical instrument of claim 1 wherein said instrument is an acoustic guitar.

3. The hollow body stringed musical instrument of claim 2 further comprising a body wherein said body further comprises:

a three layer top having an outer layer with an outer surface and an inner surface, and said inner surface has a depression between a raised flange about the periphery of said top, and about a raised flange around the periphery of a sound orifice defined therein said top, such that said depression corresponds to a thickness and configuration of a middle layer, and wherein said middle layer is a sheet of stiffening, low mass laminate positioned within said depression, and an inner layer, and further, wherein said top is contoured about a 12 to 25 foot radius;

a three ply side made of an outer skin adhesively bonded to a lightweight cellular structural engineering material middle core which is adhesively bonded to an inner skin; and a back; wherein said top is adhesively affixed to a first edge of said side and said back is adhesively affixed to a second edge of said side such that said top and said back are held in a spaced relationship.

4. The hollow body stringed musical instrument of claim 3 wherein said laminate is a sheet of conjoined continuous hollow hexagonal cell configurations made from a paper product.

* * * * *